US006243557B1

(12) United States Patent
Anthony et al.

(10) Patent No.: US 6,243,557 B1
(45) Date of Patent: Jun. 5, 2001

(54) OFFSET PREVENTING OIL PRESSURE SENSOR SYSTEM

(75) Inventors: James Denney Anthony, Victor; James Van Orchard, Holley; David Francis Cahill, Rochester, all of NY (US)

(73) Assignee: Heidelberg Digital L.L.C., Rochester, NY (US)

( * ) Notice: Subject to any disclaimer, the term of this patent is extended or adjusted under 35 U.S.C. 154(b) by 0 days.

(21) Appl. No.: 09/540,263

(22) Filed: Mar. 31, 2000

(51) Int. Cl.[7] ..... G03G 15/20
(52) U.S. Cl. ..... 399/324; 399/325
(58) Field of Search ..... 399/324, 325, 399/328; 219/216

(56) References Cited

U.S. PATENT DOCUMENTS 5,991,562 * 11/1999 Ito et al. ..... 399/67
6,032,016 * 2/2000 Morigami et al. ..... 399/325

* cited by examiner

*Primary Examiner*—Quana M. Grainger
(74) *Attorney, Agent, or Firm*—Lawrence P. Kessle

(57) ABSTRACT

A mechanism for sensing the pressure in the offset preventing oil delivery system for the fuser assembly of a reproduction apparatus. The pressure sensing mechanism includes a pressure-sensing gauge operatively associated with the offset preventing oil delivery system. A pressure sensing circuit includes a pressure gauge port for converting detected pressure from the pressure-sensing gauge into a corresponding electrical signal. Responsive to the electrical signal, the pressure sensing circuit calculates a delta voltage between when the oil delivery system is operating and when the oil delivery system is not operating, and determines whether the delta voltage system is within a specific operating range. A logic and control unit, responsive to the electrical signal, monitors the electrical signal from the pressure sensing circuit to ensure that the offset preventing oil is being properly delivered to the oil delivery system.

12 Claims, 2 Drawing Sheets

OFFSET PREVENTING OIL PRESSURE SENSOR SYSTEM

FIELD OF THE INVENTION

This invention relates in general to fuser assemblies for reproduction apparatus, and more particularly to a sensor system for sensing fuser offset preventing oil pressure for a reproduction apparatus fuser assembly.

BACKGROUND OF THE INVENTION

In typical commercial electrographic reproduction apparatus (copier/duplicators, printers, or the like), a latent image charge pattern is formed on a uniformly charged charge-retentive or photoconductive member having dielectric characteristics (hereinafter referred to as the dielectric support member). Pigmented marking particles are attracted to the latent image charge pattern to develop such image on the dielectric support member. A receiver member, such as a sheet of paper, transparency or other medium, is then brought into contact with the dielectric support member, and an electric field applied to transfer the marking particle developed image to the receiver member from the dielectric support member. After transfer, the receiver member bearing the transferred image is transported away from the dielectric support member, and the image is fixed (fused) to the receiver member by heat and pressure to form a permanent reproduction thereon.

One type of fuser assembly, utilized in typical reproduction apparatus, includes at least one heated roller and at least one pressure roller in nip relation with the heated roller. The fuser assembly rollers are rotated to transport a receiver member, bearing a marking particle image, through the nip between the rollers. The pigmented marking particles of the transferred image on the surface of the receiver member soften and become tacky in the heat. Under the pressure, the softened tacky marking particles attach to each other and are partially imbibed into the interstices of the fibers at the surface of the receiver member. Accordingly, upon cooling, the marking particle image is permanently fixed to the receiver member.

Further, with fuser assemblies of the above described type, it has been found that there is a tendency of a portion of the marking particles in an image to adhere to the pressure roller rather than remaining with the receiver member during the fusing operation. This is referred to as image offset. Thereafter the offset marking particles can transfer back to subsequent receiver members being fused to form undesirable image artifacts such as ghost images for example. Also, the offset marking particles may transfer to the fusing roller when no receiver member is present therebetween and then to the back-side of subsequent receiver members to form undesirable marks thereon. In order to minimize this image offset effect, an offset preventing oil is applied to the rollers of the fuser assembly. The offset preventing oil is preferably of a high viscosity which has been found to lower the surface energy of the rollers and makes it less likely that marking particles will adhere to the rollers.

The oiling rate for fusing roller offset preventing oil, during the fusing process, is very important in order to prevent image quality problems by ensuring proper release of receiver members and the presence of a proper amount of offset preventing oil on the roller for maintaining optimum roller material life. It has long been desired to provide a system whereby it is ensured that the fusing roller oiling system is working and delivering the proper amount of oil to the fusing roller. However, typical flow sensors and the like have not been satisfactorily usable due to the high viscosity, and very slow movement, of the offset preventing oil.

SUMMARY OF THE INVENTION

In view of the above, this invention is directed to a mechanism for sensing the pressure in the offset preventing oil delivery system for the fuser assembly of a reproduction apparatus. The pressure sensing mechanism includes a pressure-sensing gauge operatively associated with the offset preventing oil delivery system. A pressure sensing circuit includes a pressure gauge port for converting detected pressure from the pressure-sensing gauge into a corresponding electrical signal. Responsive to the electrical signal, the pressure sensing circuit calculates a delta voltage between when the oil delivery system is operating and when the oil delivery system is not operating, and determines whether the delta voltage system is within a specific operating range. A logic and control unit, responsive to the electrical signal, monitors the electrical signal from the pressure sensing circuit to ensure that the offset preventing oil is being properly delivered to the oil delivery system.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
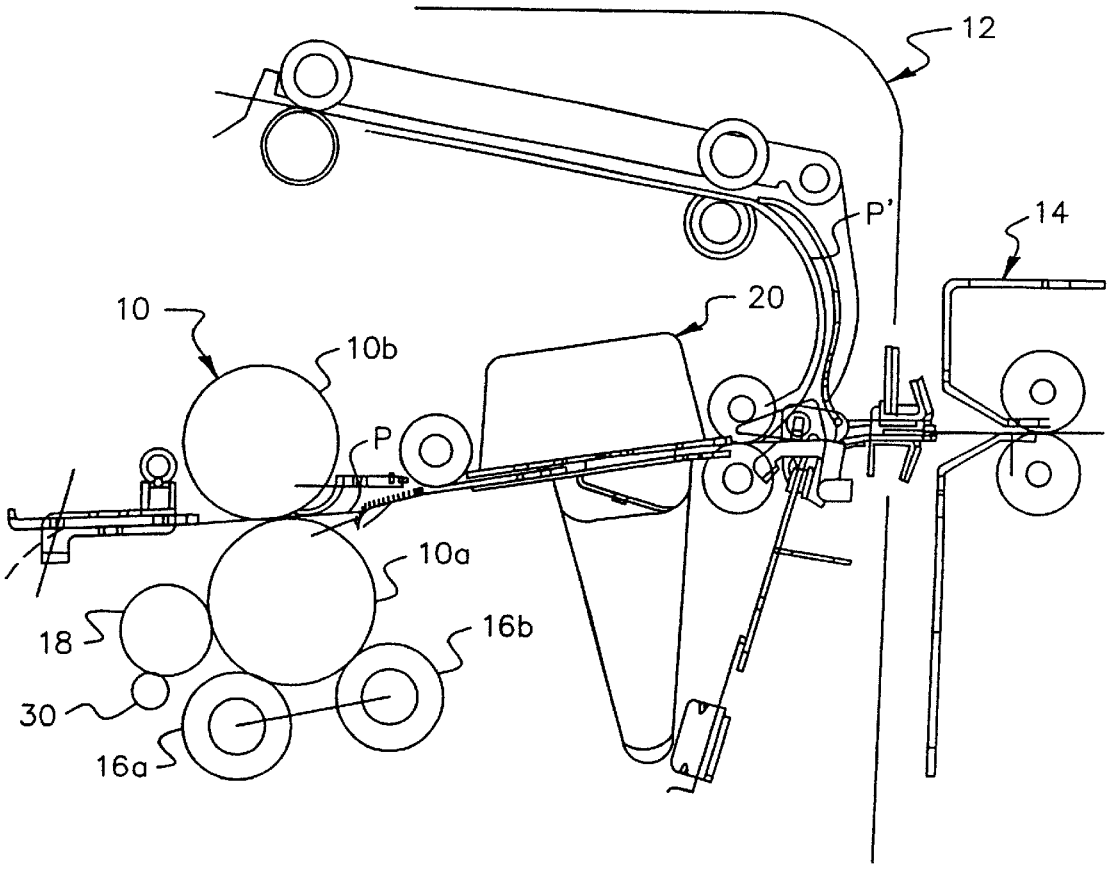
FIG. 1 is a side elevational view of an electrographic reproduction apparatus fuser assembly cleaning mechanism, shown in association with the fuser assembly and the post fuser assembly transport path, with portions broken away or removed to facilitate viewing.

Referring now to the accompanying drawings, FIG. 1 shows an exemplary fuser assembly 10 for an electrographic reproduction apparatus 12 (only a portion of the housing of the reproduction apparatus being shown in the drawings). The fuser assembly 10 includes a heated fusing roller 10*a* in nip relation with a pressure roller 10*b*. The fusing nip between the rollers 10*a*, 10*b* is associated with the transport path P of the reproduction apparatus 12. That is, as a receiver sheet bearing a marking particle image is transported along the path P, the marking particle image is fixed to a receiver sheet by application of heat and pressure in the fusing nip before the receiver sheet is delivered from the transport path P to an output device 14 or a duplex reproduction recirculation path P'. Substantially immediately downstream of the fuser assembly 10, in the direction of receiver sheet travel, is a sheet cooler device, designated generally by the numeral 20, more fully described in co-pending U.S. patent application Ser. No. 09/464,423, filed Dec. 16, 1999, in the names of Kowalski et al. Heat to the fusing roller 10*a* is supplied by a pair of external heater rollers 16*a* and 16*b* in contact with the peripheral surface of the fusing roller.

Figure 2:
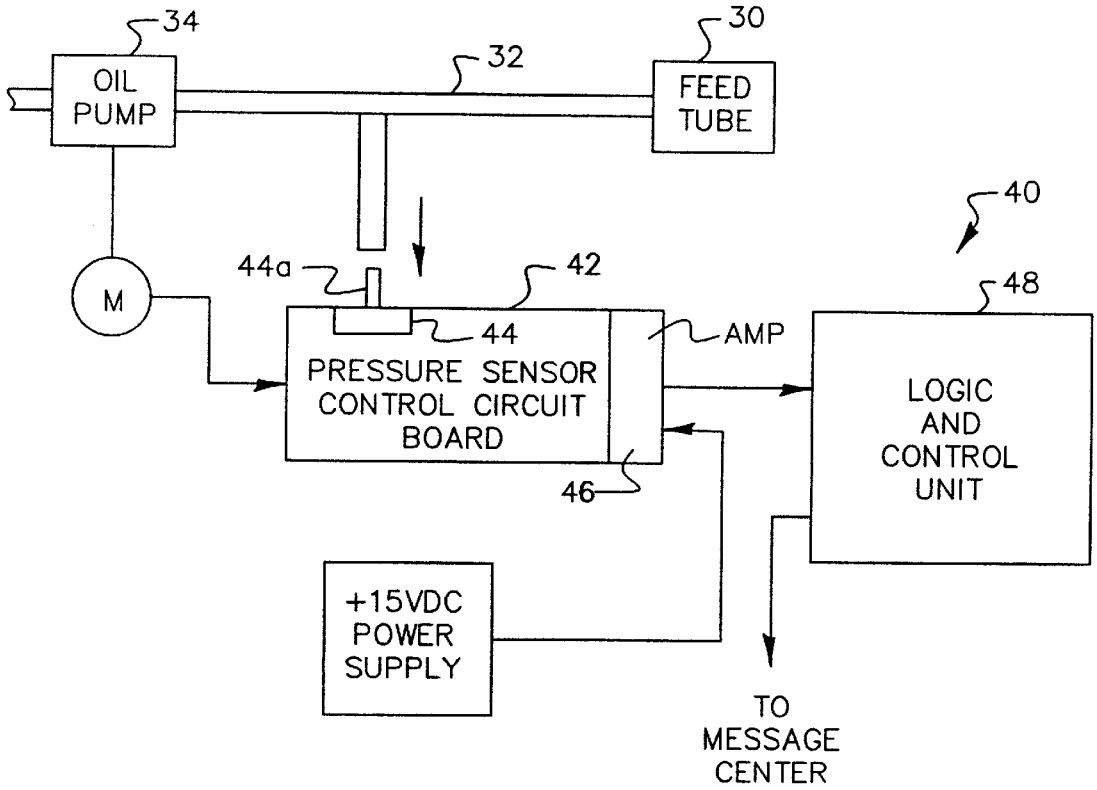
FIG. 2 is a block diagram of the reproduction apparatus fuser assembly offset preventing oil pressure sensing system, according to this invention.

Additionally, an oiler device 18, of any suitable construction well known in the prior art, contacts the fusing roller 10*a* to apply offset preventing oil to the fusing roller. The oiler device 18 includes a feed tube 30 for supplying offset preventing oil, at a metered rate, from a supply reservoir, via a flow communication conduit 32 (see FIG. 2), to the oiler device for application to the fusing roller 10*a*. A pump 34, selectively activated by a motor M, delivers the offset preventing oil at the metered rate from the reservoir to the feed tube 30. The activation of the motor M establishes the offset preventing oil delivery metering rate, such rate being preselected to ensure proper release of receiver members and the presence of a proper amount of offset preventing oil on the roller for maintaining optimum roller material life.

According to this invention, an offset preventing oil pressure sensing system, designated generally by the numeral 40, is provided. The offset preventing oil pressure sensing system 40 monitors the offset preventing oil flow to ensure oil delivery at a desired rate to the oiler device 18. The offset preventing oil pressure sensing system 40 includes a printed circuit board 42 with a pressure gauge 44 mounted thereon. The pressure gauge 44 operates, for example, to measure a pressure range of 0–30 pounds per square inch (PSI), with a sensitivity of 11.0 mvolts (0.011 volts) per PSI. The pressure port 44*a* for the pressure gauge 44 is installed in the oil feed flow communication conduit 32 between the oil pump 34 and the oil feed tube 30. Accordingly, the pressure gauge 44 will generate an electrical signal corresponding to the offset preventing oil pressure sensed by the pressure gauge.

An instrumentation amplifier 46 on the circuit board 42 processes the pressure gauge signal voltage, with a given reference offset voltage and the proper amplifier gain, to reflect a specific voltage to generate a signal that represents the oil system pressure. Such signal is then transmitted to, and processed by, a microprocessor based logic and control unit 48. The logic and control unit 48 may be the overall logic and control unit of the reproduction apparatus 12, or alternatively may be an independent dedicated logic and control unit for the offset preventing oil pressure sensor system 40. The logic and control unit 48 is programmed, in any well known manner, to monitor the signal from the circuit board 42 to ensure that the offset preventing oil is being properly delivered to the feed tube 30.

In one operational mode, the logic and control unit 48 reads the output voltage signal from the oil pressure control circuit board 42 just before the pump motor M is activated and just after the motor stops. Accordingly, the logic and control unit can calculate a delta voltage between the motor activated/motor off conditions. This delta voltage must then be within a specific operating range. If the delta voltage is not within the specific range, it is determined that an error has occurred; that is the offset preventing oil delivery rate is too high (or too low). The indication of an error may cause a signal of a fixed level to be generated, to provide an error code indicating that the system is not working properly. This error code can be used to generate a message for an operator or service personnel to indicate the need for adjustment or other service. Further, the indication of an error may cause a signal of a variable level, corresponding to a magnitude of a characteristic of the problem, to be generated, to provide feedback to adjust the offset preventing oil delivery rate.

Moreover, a pressure voltage signal from the oil pressure control circuit board 42 may also be detectable by the logic and control unit 48. Such signal is used to create an error message that indicates that the oil line 32 is not properly connected. This is especially useful after service repair or when the oiling system has been disconnected and not properly reinstalled.

The invention has been described in detail with particular reference to certain preferred embodiments thereof, but it will be understood that variations and modifications can be effected within the spirit and scope of the invention.

What is claimed is:

1. A mechanism for sensing the pressure in the offset preventing oil delivery system for the fuser assembly of a reproduction apparatus, said pressure sensing mechanism comprising:

a pressure sensing gauge operatively associated with said offset preventing oil delivery system;

a pressure sensing circuit including a pressure gauge port for converting detected pressure by said pressure sensing gauge into a corresponding electrical signal, and responsive to said electrical signal, said pressure sensing circuit calculates a delta voltage between when said oil delivery system is operating and when said oil delivery system is not operating, and determines whether said delta voltage signal is within a specific operating range; and a logic and control unit responsive to said electrical signal to monitor said electrical signal from said pressure sensing circuit to ensure that the offset preventing oil is being properly delivered to said oil delivery system.

2. The offset preventing oil pressure sensing mechanism according to claim 1 wherein said logic and control unit, in response to said electrical signal from said pressure sensing circuit determines if said oil delivery system is operating in a desired range, and if it is not operating in such desired range, generates a message signal for an operator or service personnel to indicate the need for adjustment or other service for said oil delivery system.

3. The offset preventing oil pressure sensing mechanism according to claim 1 wherein said logic and control unit, in response to said electrical signal from said pressure sensing circuit determines if said oil delivery system is operating in a desired range, and if it is not operating in such desired range, generates a signal of a variable level, corresponding to a magnitude of a characteristic of the problem, to provide feedback to adjust the offset preventing oil delivery system delivery rate.

4. The offset preventing oil pressure sensing mechanism according to claim 1 wherein said logic and control unit, in response to said electrical signal from said pressure sensing circuit determines if said oil delivery system is operating in a desired range, and if it is not operating in such desired range, generates a message signal for an operator or service personnel to indicate the need for adjustment or other service for said oil delivery system, or generates a signal of a variable level, corresponding to a magnitude of a characteristic of the problem, to provide feedback to adjust the offset preventing oil delivery system delivery rate.

5. The offset preventing oil pressure sensing mechanism according to claim 1 wherein said logic and control unit is the overall logic and control unit of the reproduction apparatus.

6. The offset preventing oil pressure sensing mechanism according to claim 1 wherein said logic and control unit is an independent dedicated logic and control unit for the offset preventing oil pressure sensor system.

7. The offset preventing oil pressure sensing mechanism according to claim 1 wherein said pressure sensing circuit senses a pressure from said pressure gauge, and generates a signal detectable by the logic and control unit used to generate an error message that indicates that said oil delivery system is not properly connected.

8. In association with an offset preventing oil delivery system for the fuser assembly of a reproduction apparatus, said oil delivery system including an oil feed tube for feeding offset preventing oil to said fuser assembly, a flow conduit communicating between an offset preventing oil reservoir and said feed tube, and a motor driven pump for delivering offset preventing oil via said flow conduit from said reservoir to said feed tube, a mechanism for sensing the pressure in the offset preventing oil delivery system, said pressure sensing mechanism comprising:

a pressure sensing gauge operatively connected to said flow conduit;

a pressure sensing circuit including a pressure gauge port for converting detected pressure by said pressure sensing gauge into a corresponding electrical signal, and responsive to said electrical signal, said pressure sensing circuit calculates a delta voltage between when said pump motor is operating and when said pump motor is not operating, and determines whether said delta voltage signal is within a specific operating range; and a logic and control unit responsive to said electrical signal to monitor said electrical signal from said pressure sensing circuit to ensure that the offset preventing oil is being properly delivered to said oil delivery system.

9. The offset preventing oil pressure sensing mechanism according to claim 7 wherein said logic and control unit, in response to said electrical signal from said pressure sensing circuit determines if said pressure in said flow conduit is in a desired range, and if it is not in such desired range, generates a message signal for an operator or service personnel to indicate the need for adjustment or other service for said oil delivery system.

10. The offset preventing oil pressure sensing mechanism according to claim 7 wherein said logic and control unit, in response to said electrical signal from said pressure sensing circuit determines if said pressure in said flow conduit is in a desired range, and if it is not in such desired range, generates a signal of a variable level, corresponding to a magnitude of a characteristic of the problem, to provide feedback to adjust the offset preventing oil delivery system delivery rate.

11. The offset preventing oil pressure sensing mechanism according to claim 7 wherein said logic and control unit, in response to said electrical signal from said pressure sensing circuit determines if said pressure in said flow conduit is in a desired range, and if it is not in such desired range, generates a message signal for an operator or service personnel to indicate the need for adjustment or other service for said oil delivery system, or generates a signal of a variable level, corresponding to a magnitude of a characteristic of the problem, to provide feedback to adjust the offset preventing oil delivery system delivery rate.

12. The offset preventing oil pressure sensing mechanism according to claim 7 wherein said pressure sensing circuit senses a pressure from said pressure gauge, and generates a signal detectable by the logic and control unit used to generate an error message that indicates that said oil delivery system is not properly connected.

* * * * *